US009493918B1

(12) United States Patent
Frey

(10) Patent No.: US 9,493,918 B1
(45) Date of Patent: Nov. 15, 2016

(54) APPARATUS FOR A CROSSWALK PEDESTAL

(71) Applicant: Robert Connell Frey, Norwood Young America, MN (US)

(72) Inventor: Robert Connell Frey, Norwood Young America, MN (US)

(73) Assignee: Robert Connell Frey Frey Manufacturing Company, Norwood Young America, MN (US)

( * ) Notice: Subject to any disclaimer, the term of this patent is extended or adjusted under 35 U.S.C. 154(b) by 0 days.

(21) Appl. No.: 14/844,276

(22) Filed: Sep. 3, 2015

(51) Int. Cl.

| | |
|---|---|
| ***E04B 1/00*** | (2006.01) |
| ***E01F 9/018*** | (2006.01) |
| ***E04H 12/00*** | (2006.01) |
| ***E04H 12/22*** | (2006.01) |

(52) U.S. Cl.
CPC ..... *E01F 9/018* (2013.01); *E04H 12/003* (2013.01); *E04H 12/2269* (2013.01)

(58) Field of Classification Search
CPC ... E01F 9/018; E04H 12/2269; E04H 12/003
USPC ..... 52/98; 248/548
See application file for complete search history.

(56) References Cited

U.S. PATENT DOCUMENTS

| | | | | | |
|---|---|---|---|---|---|
| 1,370,697 | A * | 3/1921 | Mann | E01F 9/016 | 248/160 |
| 2,945,659 | A * | 7/1960 | McDonald | E01F 9/0186 | 248/156 |
| 3,120,069 | A * | 2/1964 | Pfaff, Jr. | G09F 15/0012 | 40/607.12 |
| 3,325,950 | A * | 6/1967 | Pfaff, Jr. | E04H 12/085 | 362/431 |
| 3,381,427 | A * | 5/1968 | Watson | E01F 9/0182 | 52/296 |
| 3,552,073 | A * | 1/1971 | Millerbernd | E01F 9/0186 | 248/158 |
| 3,912,405 | A * | 10/1975 | Katt | E01F 9/0182 | 403/11 |
| 4,720,204 | A * | 1/1988 | Johnson | E04H 12/32 | 285/2 |
| 4,926,592 | A * | 5/1990 | Nehls | E01F 9/0116 | 256/13.1 |
| 5,160,111 | A * | 11/1992 | Hugron | E01F 9/0117 | 248/156 |
| 5,214,886 | A * | 6/1993 | Hugron | E01F 9/0182 | 248/548 |
| 5,484,217 | A * | 1/1996 | Carroll | E01F 9/0182 | 248/548 |
| 5,964,444 | A * | 10/1999 | Guertler | E01F 9/0118 | 248/218.4 |
| 6,216,413 | B1 * | 4/2001 | Lapointe | E01F 9/0182 | 248/548 |
| 6,382,583 | B1 * | 5/2002 | Hill, III | E01F 9/0182 | 174/40 TD |
| 6,457,895 | B1 | 10/2002 | Salman | | |
| 6,739,567 | B1 * | 5/2004 | Curtis | E01F 9/0116 | 248/519 |
| 7,434,778 | B2 * | 10/2008 | Leahy | E01F 9/018 | 248/530 |
| 7,793,910 | B2 * | 9/2010 | Salman | E01F 9/0116 | 248/519 |
| 2014/0340244 | A1 | 11/2014 | Bischoff et al. | | |

* cited by examiner

*Primary Examiner* — Basil Katcheves
(74) *Attorney, Agent, or Firm* — Bay Area Intellectual Property Group, LLC; Ariel Bentolila

(57) ABSTRACT

An apparatus includes a frangible base having a base top, a base bottom, and sides. The bottom including a plurality of openings for joining the frangible base to a surface and for passing wiring into the frangible base. The sides having at least one opening for accessing an interior of the frangible base. A stand pipe includes a pipe top, a pipe bottom, and mounting points disposed on a side of the stand pipe. The pipe bottom is configured for joining to the base top. The mounting points are configured for joining to a signaling equipment. A tether is joinable to the frangible base and the surface, wherein the tether is operable for maintaining the apparatus within a locality of a place on the surface, where the frangible base is joined to, upon a breakage of the frangible base.

13 Claims, 3 Drawing Sheets

APPARATUS FOR A CROSSWALK PEDESTAL

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to button pedestals. More particularly, the invention relates to button pedestals with frangible bases.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Button pedestals are often found at crosswalks to allow a pedestrian to press an Accessible Pedestrian Signal (APS) button for controlling traffic signals. Many state transportation departments install APS buttons on pedestals meeting Americans with Disabilities Act (ADA) standards. ADA standards may require button pedestals to be a certain height, have a certain base width, and/or be installed on varying terrains.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a current solution is to install a single pipe with a button mounted on it. The single pipe with a button mounted may be susceptible to sheering in traffic accidents, require a large base, and/or be difficult to maintain or repair.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
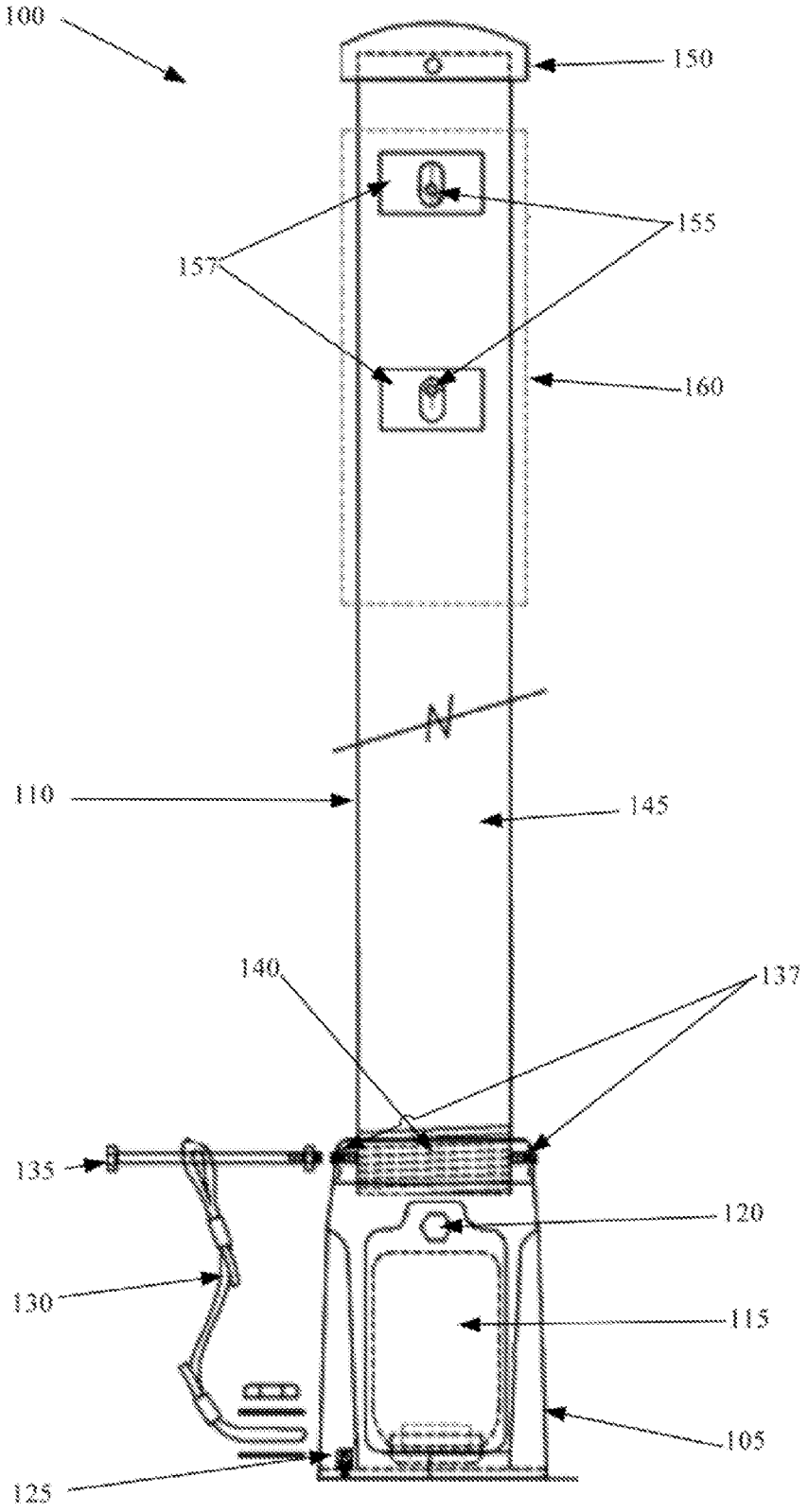
FIG. 1A illustrates an exemplary button pedestal with frangible base, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or"

unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter. Moreover, for any claim of the present invention which claims an embodiment "consisting essentially of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of only the elements recited in the original" comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to button pedestals with frangible bases. In one embodiment of the invention, a frangible base is tethered to a button stand.

FIG. 1A illustrates an exemplary button pedestal with frangible base, in accordance with an embodiment of the present invention. Button pedestal 100 comprises of a frangible base 105 and a button stand 110. Frangible base 105 comprises of an access opening 115, a door cover 120, a ground terminal 125, a cable tether 130, a tether bolt 135, and a threaded base top 140. Button stand 110 comprises of a stand pipe 145, a top cap 150, a plurality of mounting points 155, a saddle adapter 157 to change a round or polygon surface of stand pipe 145 to a flat surface, and a button panel 160 and/or mounting for other signal equipment, or switches. In some embodiments, button panel 160 may be attached to mounting points 155. In other embodiments, button panel 160 may be attached to mounting points 155 and saddle adapter 157. Button pedestal 100 may be anodized, powder coated, colored, or no finish. In many embodiments, button pedestal 100 may comply with Americans with Disabilities Act (ADA) standards. ADA standards may require button pedestals to be a certain height, have a certain base width, and/or be installed on varying terrains.

Frangible base 105 may be made from a frangible material such as, but not limited to, aluminum, plastic, fiberglass, metals, or other solid materials and is designed to be destroyed when a large force such as, but not limited to, a traffic collision is applied. An access opening 115 may be located on a side of frangible base 105 to allow a person to easily access any inner components such as, but not limited to, a ground lug, anchor bolts and electronics within button pedestal 100. A door cover 120 may be part of frangible base 105 to allow for access opening 115 to be locked by a locking mechanism such as, but not limited to, a bolt and lock washer, anti-vandalism hardware, latch, combination lock, thru-bolt, and lock and key. In some embodiments, door cover 120 may be customized with a logo or other design. A ground terminal 125 may meet the National Electrical Code for frangible base 105 and/or button stand 110 to be electrically grounded. A cable tether 130 may be attached to an anchor bolt inside of frangible base 105 on one end and connected to a tether bolt 135 on the other end. Tether bolt 135 may lock into place by sliding through guiding holes located on a threaded base top 140 and a stand pipe 145. A threaded base top 140 comprises of a threaded circular opening on top of frangible base 105. Threaded base top 140 allows for a stand pipe 145 that is threaded on one end to be attached to frangible base 105. In some embodiments, stand pipe 145 may also be secured with set screws 137.

Stand pipe 145 may be a pipe made of a durable material such as, but not limited to, aluminum, steel, plastic, fiberglass, or other metals, alloys, and solid materials. A top cap 150 may be used to seal one end of stand pipe 145 and may be made of a durable and pliable material such as, but not limited to, aluminum, steel, plastic, rubber, or other metals, alloys, and solid materials. Mounting points 155 may be located on stand pipe 145 and may be designed to hold a button panel 160 and/or other signal equipment at a standard height. Button panel 160 may be any panel or button such as, but not limited to, an Accessible Pedestrian Signal button, switch or signal equipment.

During typical installation, electronics are installed within stand pipe 145 and/or frangible base 105. If the electronics require electrical grounding, ground wires may be connected to ground terminal 125. Frangible base 105 may be affixed to the ground by a variety of ways and means such as, but not limited to, anchor bolts, ground bolts, and plate anchor with a ball in socket, or a receiver plate. Shims may also be used to level the frangible base 105. In some embodiments, cement or walkway material may be drilled to receive an anchor 210, FIG. 2, and secured with epoxy. In other embodiments, other anchor types may also be installed in wet walkway material such as, without limitation, cement during new construction. One end of cable tether 130 may be affixed to an anchor point 210 and the other end, attached to tether bolt 135 inside the frangible base 105, and may be locked together with stand pipe 145 and threaded base top 140. In some embodiments, if tether 130 is not used, set screws 137 may secure the stand pipe 145 and threaded base top 140.

During an event where excessive force is applied to button pedestal 100, frangible base 105 is designed to break such that force exerted on button stand 110 is mitigated. Tether 130 may further mitigate force exerted on button stand 110 and keep button stand 110 in a general area after an event where excessive force is applied. Stand pipe 145 may be designed to protect electronics within button stand 110 and further mitigate force exerted on button stand 110.

It may be appreciated by a person with ordinary skill in the art that a frangible base 105 may be made frangible by either material choice or design. Frangible base 105 may be made from a brittle material and/or engraved with weak points such that frangible base 105 will fail in a certain orientation. Frangible base 105 may be made from materials such as, but not limited to, aluminum, plastic, steel, fiberglass, or other metals, alloys, and solid materials. In another embodiment of the present invention, frangible base 105 may be made from new ingot grade 319 and other cast aluminum alloys and treatments.

It may be appreciated by a person with ordinary skill in the art that access opening 115 may be any design. Access cover 120 may be any shape, size, and/or material such as, but not limited to, an aluminum cover, magnetic curtain, hinged plastic door, and a rubber fitting, or other solid material. In another embodiment of the present invention, access cover 120 may be a threaded cap that can be opened and closed by clockwise rotation.

It may be appreciated by a person with ordinary skill in the art that door cover 120 may be any sort of locking mechanism for access opening 115. Door cover 120 may be, but not limited to, attached by a combination lock, adhesive seal, anti-vandalism hardware, latch, combination lock, thru-bolt, and lock and key. In another embodiment of the present invention, door cover 120 may be attached with a bolt and lock washer.

It may be appreciated by a person with ordinary skill in the art that ground terminal 125 may be a part of frangible base 105 and/or button stand 110. In an alternative embodiment of the present invention, the inner sides of frangible base 105 and/or button stand 110 may be electrically connected with a conductive material such as, but not limited to, copper to electrically ground all metal surfaces of frangible base 105 and/or button pedestal 100.

It may be appreciated by a person with ordinary skill in the art that threaded base top-140 may connect to stand pipe 145 in a variety of ways. Threaded base top 140 may connect to stand pipe 145 by means such as, but not limited to, magnetics, locking joints, ball in socket, thru-bolt, clamp, and adjusting washers. In another embodiment of the present invention, threaded base top 140 may connect with stand pipe 145 by way of a high friction surface.

It may be appreciated by a person with ordinary skill in the art that tether 135 may be made from any durable material such as, but not limited to, steel cable, steel wire, and rubber. In another embodiment of the invention, tether 135 may be made from ⅛ inch stainless steel rope.

It may be appreciated by a person with ordinary skill in the art that top cap 150 may be any device that covers the open end of stand pipe 145. Top cap 150 may be, but not limited to, an aluminum cap, a plastic cap, a cork, threaded metal or alloy, and rubber cap. In another embodiment of the present invention, top cap 150 may be a tapered heat sealed and press fit aluminum cap secured with set screws.

It may be appreciated by a person with ordinary skill in the art that threaded base top 140 may be a variety of joints to allow stand pipe 145 varying degrees of freedom. Threaded base top 140 may be, but not limited to, a swivel joint, a telescoping joint, and adjusting washers. In an alternative embodiment of the present invention, threaded base top 140 may be a ball and socket joint that allows stand pipe 145 to rotate in a small radius.

It may be appreciated by a person with ordinary skill in the art that stand pipe 145 may be any shape and/or size to accommodate any specific application. Stand pipe 145 may be, but not limited to, round, a rectangular prism, a branching tree, polygon, and a square column. In an alternative embodiment of the present invention, stand pipe 145 may be an arch such that a button panel 160 may reach a location.

It may be appreciated by a person with ordinary skill in the art that stand pipe 145 need not be a single unit. Stand pipe 145 may be, but not limited to, a combination of different modules, or telescoping segments. In an alternative embodiment of the present invention, stand pipe 145 may be a plurality of short interlocking cylinders that may be modularly combined to achieve a specific height, breadth, or width for stand pipe 145.

It may be appreciated by a person with ordinary skill in the art that button pedestal 100 may be filled with a shock absorbing material. Button pedestal 100 may be filled with shock absorbing material such as, but not limited to, foam to mitigate any applied force.

Figure 1B:
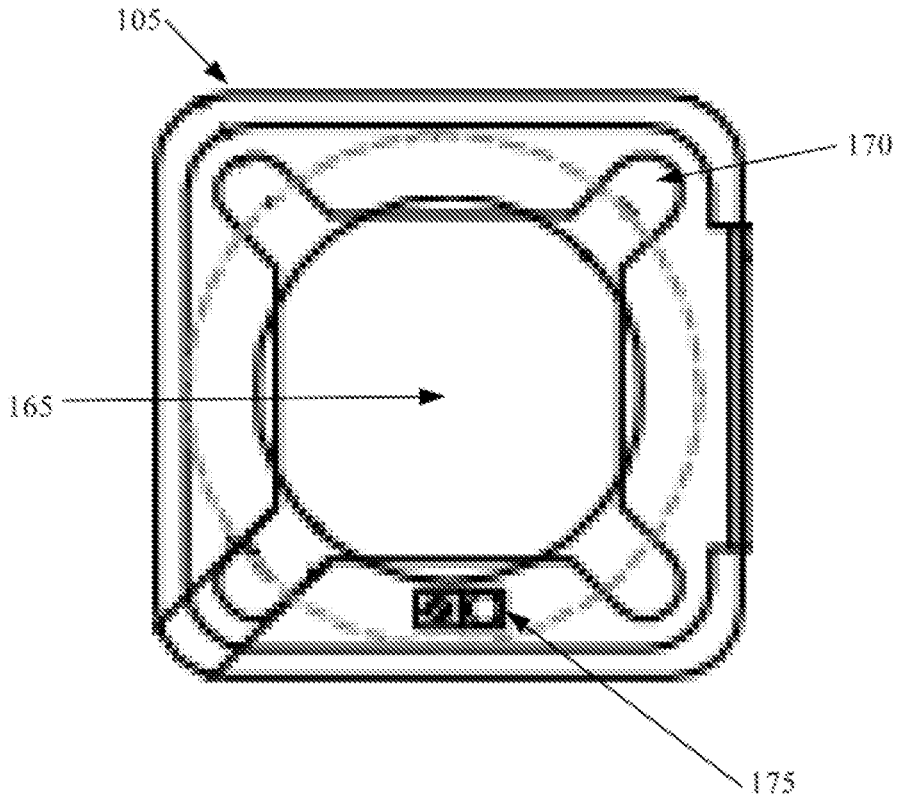
FIG. 1B illustrates the bottom of an exemplary button pedestal with frangible base, in accordance with an embodiment of the present invention.

FIG. 1B illustrates the bottom of an exemplary button pedestal with frangible base, in accordance with an embodiment of the present invention. A frangible base 105 comprises of a plurality of bottom openings 165, a plurality of bolt slots 170, and a ground terminal hole 175. A bottom opening 165 may allow access within frangible base 105 for electrical cables or be retrofitted over a failed pipe mount. A plurality of bolt slots 170 may serve as points for anchors such as, but not limited to, anchor bolts, ground bolts, and plate anchor with a ball in socket, or receiving plate. A terminal hole 175 allows for frangible base 105 to have direct ground access and may serve as a location for a ground terminal.

It may be appreciated by a person with ordinary skill in the art that frangible base 105 may be any shape and/or size. Frangible base may be, but not limited to, a wide pyramid, flat circular platform, etc. In another embodiment of the present invention, frangible base 105 may be a cylinder with the same dimensions as stand pipe 145 so as to make button pedestal 100 appear as a single unit with base top threads 140 being external instead of internal.

It may be appreciated by a person with ordinary skill in the art that the plurality of bolt slots 170 may be any number, shape, size, design, and/or orientation to anchor to any point. The plurality of bolt slots may be, but not limited to, a set of adhesive pads, weld points, slots, holes, anchors, clips, or tie downs. In another embodiment of the present invention, frangible base 105 has four bolt slots which slide-mount onto anchor points on the ground. In still another embodiment of the present invention, the plurality of bolt holes or slots 170 may be adhesive pads to allow frangible base 105 to stick to a surface.

Figure 2:
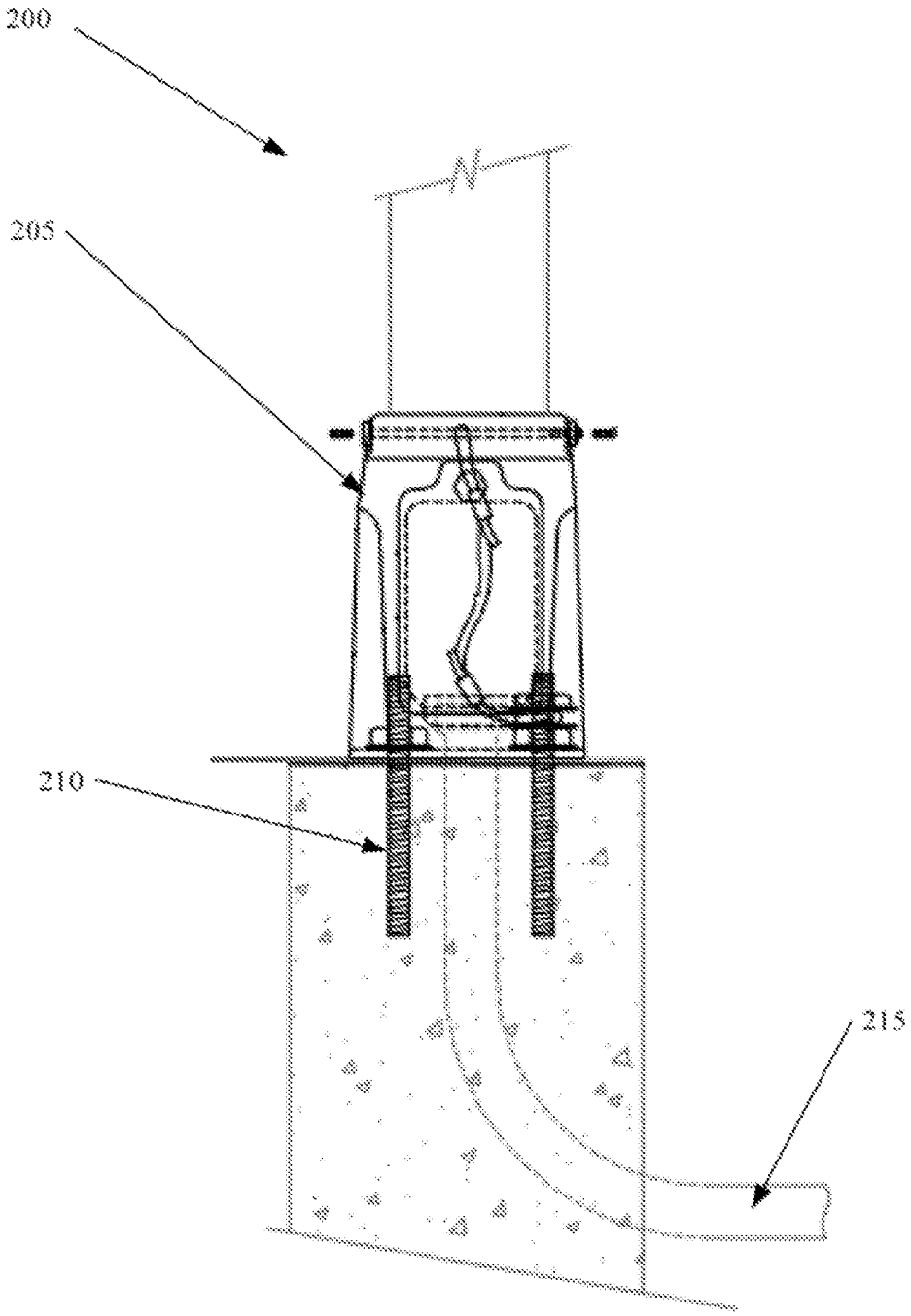
FIG. 2 illustrates an exemplary button pedestal with anchor bolts, in accordance with an embodiment of the present invention.

FIG. 2 illustrates an exemplary button pedestal with anchor bolts, in accordance with an embodiment of the present invention. Button pedestal 200 comprises of a frangible base 205 that is mounted to a secured surface such as, but not limited to, a grade, sidewalk, pier, curb, concrete, or metal plates. Frangible base 205 is mounted to a surface by anchoring bolts 210. A wireway 215 may be burrowed underneath frangible base 205 so that wires and/or pipes may reach the inside of button pedestal 200.

It may be appreciated by a person with ordinary skill in the art that button pedestal 200 may be mounted in any orientation. In an alternative embodiment of the present invention, button pedestal 200 may be mounted to the side of a building by anchoring bolts 210.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing button pedestals with frangible bases according to the present invention will be apparent to those skilled in the art. Various aspects of the invention have been described above by way of illustration, and the specific embodiments disclosed are not intended to limit the invention to the particular forms disclosed. The particular implementation of the button pedestals with frangible bases may vary depending upon the particular context or application. By way of example, and not limitation, the button pedestals with frangible bases described in the foregoing were principally directed to button pedestals with frangible bases implementations; however, similar techniques may instead be applied to display stands, construction mounts, and security stations, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

a frangible base configured for installation on a varying terrain ground surface, said frangible base comprising:
- a base top, wherein said base top comprises at least a threaded circular opening disposed on a proximate top portion of said frangible base;
- a base bottom, wherein said bottom comprising at least a plurality of openings being configured for joining said frangible base to the ground surface and for passing wiring into said frangible base;
- an access opening, said access opening comprising at least one opening configured for accessing an interior of said frangible base;
- a door cover implement comprising of a locking mechanism that is configured to prevent vandalism of said frangible base interior;
- a ground terminal implement, wherein said ground terminal implement being configured to electrically ground said frangible base to the ground surface; and
- a weak point portion, said weak point portion is configured to fail in a predetermined orientation;

a button stand comprising:
- a stand pipe;
- a pipe top section, said pipe top section disposed on a proximate top portion of said stand pipe;
- a pipe bottom section, wherein said pipe bottom is a threaded pipe bottom section being configured for joining said stand pipe to said threaded frangible base top;
- a mounting point constituent disposed on a side of said stand pipe, said mounting point constituent comprising at least two or more mounting points being configured for joining to a at least an electronic signaling equipment, wherein said electronic signaling equipment comprises a button panel;
- said button stand electrically connected to said ground terminal implement and configured to provide support for said electronic signaling equipment, wherein said button stand is configured to mitigate an excessive force exerted on said electronic signaling equipment, and wherein said frangible base is further configured to break at said weak point portion when said excessive force is exerted on said button stand;

and a cable tether piece being joinable to said frangible base and the ground surface, wherein said tether piece is operable for maintaining said apparatus within a locality of a place on the ground surface, and where said frangible base is joined to, upon said breakage of said frangible base.

2. The apparatus as recited in claim 1, in which said door cover implement further comprising at least one of a logo and a seal design.

3. The apparatus as recited in claim 1, further comprising a top cap for covering said pipe top section, wherein said top cap comprises a tapered heat sealed and press fit aluminum cap secured with set screws.

4. The apparatus as recited in claim 1, further comprising a tether bolt for joining said cable tether piece to a top portion of said frangible base and a bottom portion of said stand pipe.

5. The apparatus as recited in claim 1, further comprising a saddle adapter for providing a flat surface area for said signaling equipment.

6. The apparatus as recited in claim 1, further comprising set screws for securing said stand pipe to said frangible base in addition to said threaded connection of said pipe bottom section and frangible base top.

7. The apparatus as recited in claim 1, further comprising anchoring bolts for joining said frangible base to the ground surface.

8. The apparatus as recited in claim 1, in which said electronic signaling equipment comprises a button panel.

9. The apparatus as recited in claim 1, in which said base top and said pipe bottom section are threaded connections and secured with a set screw.

10. The apparatus as recited in claim 1, a tether bolt disposed inside said frangible base and locked together with said stand pipe and said threaded base top.

11. The apparatus as recited in claim 10, further comprising an anchor point, wherein one end of said cable tether piece is affixed to said anchor point and the other end attached to said tether bolt.

12. The apparatus as recited in claim 1, in which said apparatus further comprising a tether bolt guiding hole disposed on said threaded base top configured to lock into place a tether bolt, wherein said cable tether piece is coupled to said tether bolt and said ground terminal implement to provide electrical grounding of said stand pipe.

13. An apparatus comprising:

a frangible base section configured for installation on varying terrain ground surfaces, said frangible base section comprising:

a base top portion, said base top portion comprising threads;

a base bottom portion, said base bottom portion comprising at least a plurality of openings configured for joining said frangible base section to a ground surface and for passing wiring into said frangible base section;

a ground terminal implement, wherein said ground terminal implement being configured for electrically grounding said frangible base section to the ground surface;

an access opening, said access opening comprising at least one opening for accessing an interior of said frangible base;

an anchoring bolt, wherein said anchoring bolt comprises at least two or more anchoring bolts configured for joining said frangible base to the ground surface;

a door cover implement configured for covering said at least one opening to prevent vandalism of said frangible base interior, wherein said door cover implement is customizable, in which said customizable door cover implement comprises at least a logo;

a ground terminal implement, wherein said ground terminal implement being configured for electrically grounding said frangible base section to the ground surface; and a weak point portion, said weak point portion is configured to fail in a predetermined orientation;

a button stand section comprising:

a stand pipe implement;

a pipe top portion disposed on a proximate top portion of said stand pipe implement;

a pipe bottom portion, said pipe bottom portion comprising threads for threading into said base top portion, a mounting point constituent, said a mounting point constituent comprising at least two or more mounting points disposed on a side of said stand pipe implement, said at least two or more mounting points being configured for joining to an electronic signaling equipment;

in which said electronic signaling equipment comprises at least a button panel;

a top cap implement configured for covering said pipe top portion;

a saddle adapter portion configured for providing a flat surface area for said electronic signaling equipment at said at least two or more mounting points; and wherein said button stand section is electrically connected to said ground terminal implement and configured to provide support for said electronic signaling equipment, wherein said button stand is configured to mitigate an excessive force exerted on said electronic signaling equipment, and wherein said frangible base section is further configured to break at said weak point portion when said excessive force is exerted on said button stand section;

a tether implement comprising a first end and a second end, said tether implement being joinable to said frangible base section and the ground surface, wherein said tether implement is operable for maintaining said apparatus within a locality of a place on the ground surface, where said frangible base section is joined to, upon a breakage of said frangible base section;

a tether bolt implement for joining said first end of said tether implement to a top portion of said frangible base section and a bottom portion of said stand pipe implement;

a tether bolt guiding hole implement disposed on said threaded base top portion configured to lock into place said tether bolt implement; and an anchor point implement coupled to said anchoring bolts, wherein said second end of said tether implement is affixed to said anchor point implement and the other end is attached to said tether bolt implement.

* * * * *